US006070657A

United States Patent [19]

Kunkel

[11] Patent Number: 6,070,657

[45] **Date of Patent: *Jun. 6, 2000**

[54] HEAT EXCHANGER TUBE FOR HEATING BOILERS

[75] Inventor: Wolfgang Kunkel, Triesten, Liechtenstein

[73] Assignee: Hoval Interliz AG, Liechtenstein

[ * ] Notice: This patent issued on a continued prosecution application filed under 37 CFR 1.53(d), and is subject to the twenty year patent term provisions of 35 U.S.C. 154(a)(2).

[21] Appl. No.: 08/704,592

[22] PCT Filed: Mar. 15, 1995

[86] PCT No.: PCT/EP95/00957

§ 371 Date: Sep. 16, 1996

§ 102(e) Date: Sep. 16, 1996

[87] PCT Pub. No.: WO95/25937

PCT Pub. Date: Sep. 28, 1995

[30] Foreign Application Priority Data

Mar. 24, 1994 [DE] Germany ..... 94 05 062 U

[51] Int. Cl.[7] ..... F28F 1/40; F28F 1/42

[52] U.S. Cl. ..... 165/158; 165/179; 165/183; 138/38; 138/157

[58] Field of Search ..... 165/133, 154, 165/164, 179, 183, 158; 138/38, 114, 115, 156, 157, 162, 166

[56] References Cited

U.S. PATENT DOCUMENTS

| | | | |
|---|---|---|---|
| 813,918 | 2/1906 | Schmitz | 138/38 X |
| 1,350,073 | 8/1920 | Dow | 138/157 X |
| 1,692,529 | 11/1928 | Zagorski | 138/157 X |
| 2,618,738 | 11/1952 | Foulds | 165/179 X |
| 3,267,563 | 8/1966 | Seaton | 165/179 X |
| 3,267,564 | 8/1966 | Keyes | 165/179 X |
| 3,870,081 | 3/1975 | Kleppe et al. | 138/28 |
| 4,899,813 | 2/1990 | Menicatti et al. | 165/133 |

FOREIGN PATENT DOCUMENTS

| | | | |
|---|---|---|---|
| 993977 | 11/1951 | France | 165/183 |
| 1422003 | 11/1965 | France | 165/183 |
| 821777 | 10/1951 | Germany | 138/38 |
| 63-96493 | 4/1988 | Japan | 165/179 |
| 20606 | 12/1899 | Switzerland | 138/38 |
| 1462076 | 2/1989 | U.S.S.R. | 165/183 |
| 7886 | of 1902 | United Kingdom | 165/179 |

*Primary Examiner*—Leonard Leo
*Attorney, Agent, or Firm*—Blakely Sokoloff Taylor & Zafman

[57] ABSTRACT

The heat exchanger tube comprises a cylindrical, smooth walled outer tube (1) of steel into which a profiled insert (2) of aluminium is inserted. The profiled insert is constituted by two half shells (3,4) which engage in one another at their longitudinal edges with groove-shaped recesses (7) and rib-like projections (8). Both half shells (3,4) carry longitudinally extending ribs (5) on their internal surface which are so aligned that each half shell with its ribs constitutes a profile which is open on one side.

9 Claims, 4 Drawing Sheets

HEAT EXCHANGER TUBE FOR HEATING BOILERS

DESCRIPTION

The invention relates to a heat exchanger tube for heating boilers, particularly for gas condensing boilers, in accordance with the precharacterising portion of claim 1.

In condensing boilers, which are principally gas fired heating boilers, the combustion gases are cooled until the exhaust gas moisture condenses in order to utilise the heat of condensation. The prerequisite for this is that the heating boiler is operated with a boiler water temperature which is lower at the end of the combustion gas path through the heating boiler than the dew point temperature of the combustion gases. One endeavours to cool the combustion gases over as short as possible a path of the combustion gases through the water cooled heat exchanger tubes of the heating boiler from the high inlet temperature, which can be about 850° C. with modern gas burners, to a temperature which is between the dew point temperature and the lowest boiler water temperature of e.g. 30° C. prevailing at the heated water return. Heat exchanger tubes are known for this purpose which comprise a cylindrical, smooth walled outer tube of steel which is resistant to acid corrosion by the exhaust gas condensate and an aluminium profiled insert of star-shaped cross-section pushed into the outer tube. For heating boilers of the most usual construction the outer tube must comprise steel in order to be able to be welded at its ends into tube bases or tube plates which separate the boiler water space surrounding the heat exchanger tubes from the combustion chamber on the one hand and from the exhaust gas manifold of the heating boiler on the other hand. The composite tube consisting of the steel outer tube and aluminium profiled insert can be subjected to high inlet gas temperatures because aluminium has a larger coefficient of expansion than steel so that the profiled insert remains in thermally conductive contact with the outer tube at its contact points with the external tube with a pressure which actually increases with increasing temperature. In the known composite tube the transfer of heat from the star-shaped aluminium profiled insert to the steel outer tube is determined and limited by the fact that the profiled insert contacts the outer tube only at the ridge surfaces of the radiating arms of the profiled insert which are relatively thin walled in cross-section in order to leave a sufficient area free in the outer tube for the flow of combustion gas. It has also proved to be necessary for the welding of the steel outer tube into the tube plates that at the ends of the outer tube the ends of the star-shaped aluminium profiled insert must be sufficiently set back in order to prevent the radiating arms of the aluminium profiled insert being destroyed by the welding heat produced at the outer tube ends.

The invention has the object of providing a heat exchanger tube of the type referred to above which makes an even greater heat transfer capacity possible from the combustion gases to the boiler water and can be simply manufactured and further processed when being installed in a heating boiler. The invention solves this object by the construction of the heat exchanger tube constituted by a composite tube of a steel outer tube and an aluminium profiled insert with the characterising features of claim 1.

The tubular body-shaped profiled insert of the heat exchanger tube in accordance with the invention can be constructed on the one hand with a very large internal surface area which receives heat from the combustion gases, preferably with ribs disposed in the manner of a comb on the internal surface of the two half shells, and, above all, engages the inner surface of the water cooled steel outer tube with a substantially larger outer surface area in comparison to the known star profiles, whereby the heat transfer capacity from the combustion gases to the boiler water is significantly increased. It has been determined in experiments that with a condensing boiler, in which the returned heating water has a water temperature of about 30° C. on entry into the heating boiler, a tube length of the heat exchanger tube in accordance with the invention of only 50 cm can result in the combustion gases flowing into the heat exchanger tube at a temperature of about 850° C. being able to be cooled in the heat exchanger tube in accordance with the invention to an outlet temperature only a little above the returned water temperature of about 48° C. This excellent result was not achieveable with any heat exchanger tube which was previously known and suitable for boilers. The shortness of the heat exchanger tube results in the further substantial advantage that the condensing boiler can be constructed overall to be lower with a vertical arrangement of the heat exchanger tubes or shorter with a horizontal arrangement of the heat exchanger tubes and thus in a more space saving manner. Despite the construction of the profiled insert with a large contact area with the outer tube and with a large heating surface density in the interior, the tubular body-shaped profiled insert may be simply and economically manufactured due to its division into two half shells and due to the construction of each half shell with its ribs as a profile which is open on one side. For manufacture by extrusion, no so-called flying cores are required in the drawing die which is thus cheap and also has a long service life. It has proved to be a particular advantage for the further processing of the heat exchanger tube in accordance with the invention or for its installation in a heating boiler that when welding the outer tube into a tube plate the aluminium profiled insert is not destroyed, thanks to the extremely large thermal transfer contact area and thermal dissipation ability of the profiled insert, if the end of the profiled insert extends to be flush with the end of the outer tube to be welded into the tube plate. The heat exchanger tube thus does not need to be manufactured with the ends of the profiled insert set back with respect to the ends of the outer tube and instead simple straight cutting into the required length from manufactured long piece goods can be used for installation in a heating boiler. The construction of the contacting longitudinal edges of the two half shells with a type of labyrinth seal comprising groove-shaped recesses and rib-like projections prevents the formation of a gap through which the exhaust gas or condensate could penetrate between the aluminium profiled insert and the steel outer tube and result in gap corrosion. If the profiled insert directly engages the outer tube over the entire peripheral surface of the tubular body in the simplest embodiment of the heat exchanger tube in accordance with the invention, the manufacture of the heat exchanger tube can be effected in a simple manner so that the tubular body has an external diameter which substantially corresponds to the internal diameter of the outer tube and is only slightly smaller so that the tubular body can be slid effortlessly into the outer tube and that the outer tube is thereafter radially compressed by a permanent compression deformation of the entire periphery of the outer tube, for instance by a rolling or drawing process, and pressed against the aluminium profiled insert. The contacting longitudinal edges of the two half shells and also the tubular body and the outer tube are thereby intimately pressed together so that absolutely no gap is present. This is also important for the end faces of the ends of the heat exchanger tube extending through the tube plates so that no exhaust gas or condensate can penetrate there between the tubular body of the aluminium profiled insert and the steel outer tube.

Advantageous further features of the heat exchanger tube in accordance with the invention are characterised in the dependent claims.

Various exemplary embodiments of the heat exchanger tube in accordance with the invention are illustrated in the drawings, in which.

Figure 1:
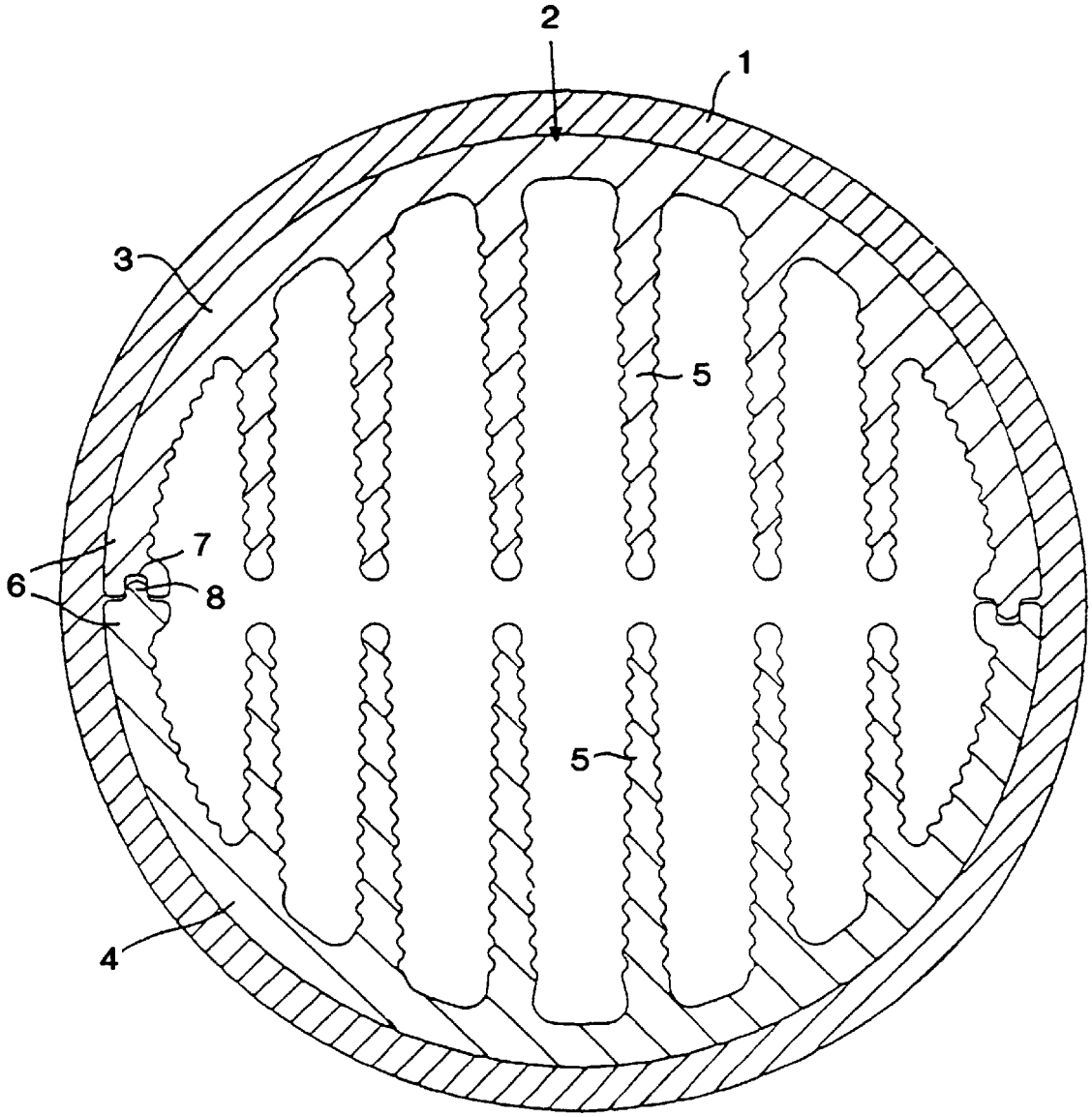
FIG. 1 shows an embodiment of the heat exchanger tube with an aluminium profiled insert directly engaging the steel outer tube.
Figure 4:
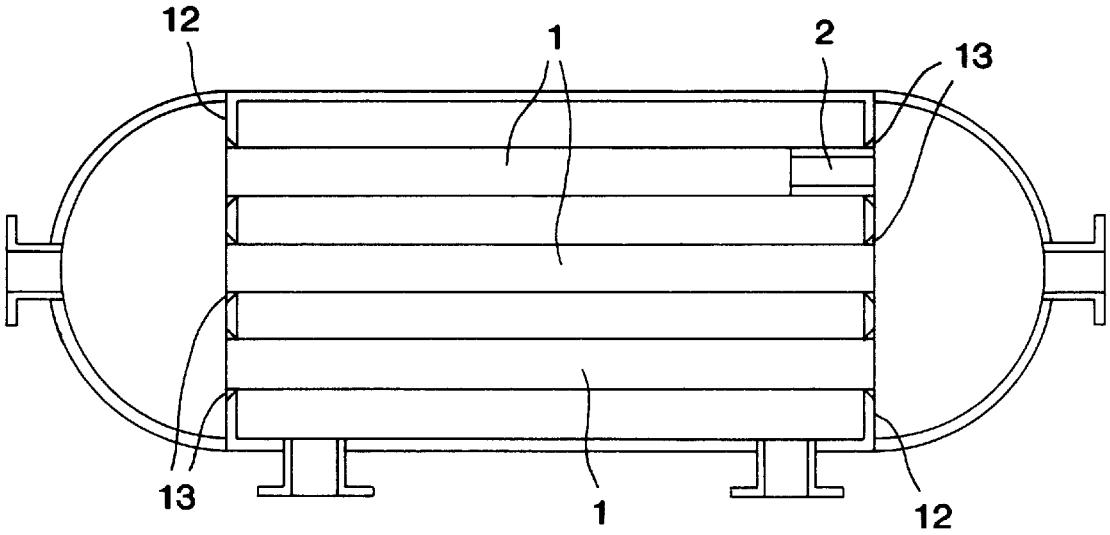
FIG. 4 shows an embodiment of a heating boiler having tube plates and welding seams for connecting the outer tubes to the tube plates.

The heat exchanger tube shown in FIG. 1 comprises a cylindrical, smooth walled outer tube 1 of a corrosion-resistant chromium steel and a profiled insert 2 of aluminium. The profiled insert 2 is constituted by an annular body which is divided into two half shells 3,4 in a joint plane extending through the longitudinal axis of the outer tube. The two half shells 3,4 are formed on their inner shell surface with ribs 5 which extend in the longitudinal direction of the outer tube 1 and project into the free cross-section of the tubular body so that each half shell 3,4 with its ribs 5 constitutes a profile which is open on one side so that the half shells can be simply and cheaply manufactured with their ribs with an extrusion tool or drawing die without a so-called flying core. The ribs 5 are particularly advantageously arranged, as shown by the exemplary embodiment of FIG. 1, in the manner of a comb extending perpendicular to the joint plane on the inner surface of the two half shells 3,4, whereby the ribs 5 of the two half shells 3,4 are opposed to one another in pairs and extend to or at least to the vicinity of the joint plane. Particularly with this comb-like arrangement of the ribs 5, the ribs can be provided during the extrusion fabrication of the half shells with a ridge-like surface profiling which extends in the longitudinal direction of the outer tube 1 or of the half shells 3,4 and results in a very effective increase of the heat-receiving internal surface area of the profiled insert 2 which is acted upon by the combustion gases. At their longitudinal edges 6, which contact one another in the joint plane, the two half-shells 3,4 are provided with groove-like recesses 7 and rib-like projections 8 which may be inserted into one another perpendicular to the joint plane and with which the longitudinal edges engage in one another in the manner of a labyrinth seal. The seal of the two abutment points between the longitudinal edges of the half shells is important so that no gap is produced through which exhaust gas or condensate penetrates between the tubular body of the profiled insert 2 and the outer tube 1 and results there in gap corrosion. If the two half shells, as shown in FIG. 1, are constructed at the one longitudinal edge with a groove-shaped recess and at the other longitudinal edge with a rib-shaped projection, the two half shells can be cut from the same profiled web produced by extrusion in the necessary length and the one half shell fits on the other half shell, rotated through 180° about the longitudinal axis. For the sake of clarity, FIG. 1 shows the heat exchanger tube in the state in which it is not yet finally completed. The tubular body comprising the two half shells 3,4, joined together, which directly engages the outer tube 1 over its entire peripheral surface, is manufactured with an external diameter which is slightly smaller than the internal diameterof the outer tube so that the tubular body or the profiled insert 2 may be pushed without difficulty into the outer tube. The outer tube is thereafter subjected over its entire periphery to a permanent radial compression deformation by a rolling or drawing process in order to press the outer tube and the profiled insert against one another to produce an intensive contact of the entire internal surface of the outer tube and the entire outer surface of the profiled insert which is important for the heat transfer. The longitudinal edges, which engage in one another with the recesses and projections, of the two half shells are thereby also pressed together with no gap and absolutely sealed against exhaust gas or condensate in such a manner that no seam may be detected between the longitudinal edges of the half shells even in a microsection of the cross-section of the finished heat exchanger tube. The gapless compression of the outer tube and profiled insert at the contacting peripheral surfaces also prevents exhaust gas or condensate being able to penetrate between the outer tube and profiled insert at the end face of the heat exchanger tube installed in a heating boiler. The extremely high heat transfer capacity of the heat exchanger tube between the profiled insert and outer tube also has a surprisingly advantageous effect for the reverse heat flow when welding the ends of the heat exchanger tube in to tube bases or tube plates of a heating boiler as shown in FIG. 4. FIG. 4 shows an embodiment of a heating boiler having tube plates 12 and welding seams 13 for connecting the outer tubes 11 to the tube plates 12. As shown in FIG. 4, the ends of the profiled inserts 2 are flush with the outer tubes 1. Welding experiments have shown that even when the end face of the aluminium profiled insert is flush with the chromium steel outer tube, the aluminium is surprisingly not damaged or does not melt away although the chromium steel outer tube must be connected to the tube plate of the heating boiler with liquid molten welding material. The heat exchanger tube can thus be cut off in the lengths required for a heating boiler with a simple straight severing or sawing cut or the like from finished standard lengths of the heat exchanger tube.

Figure 2:
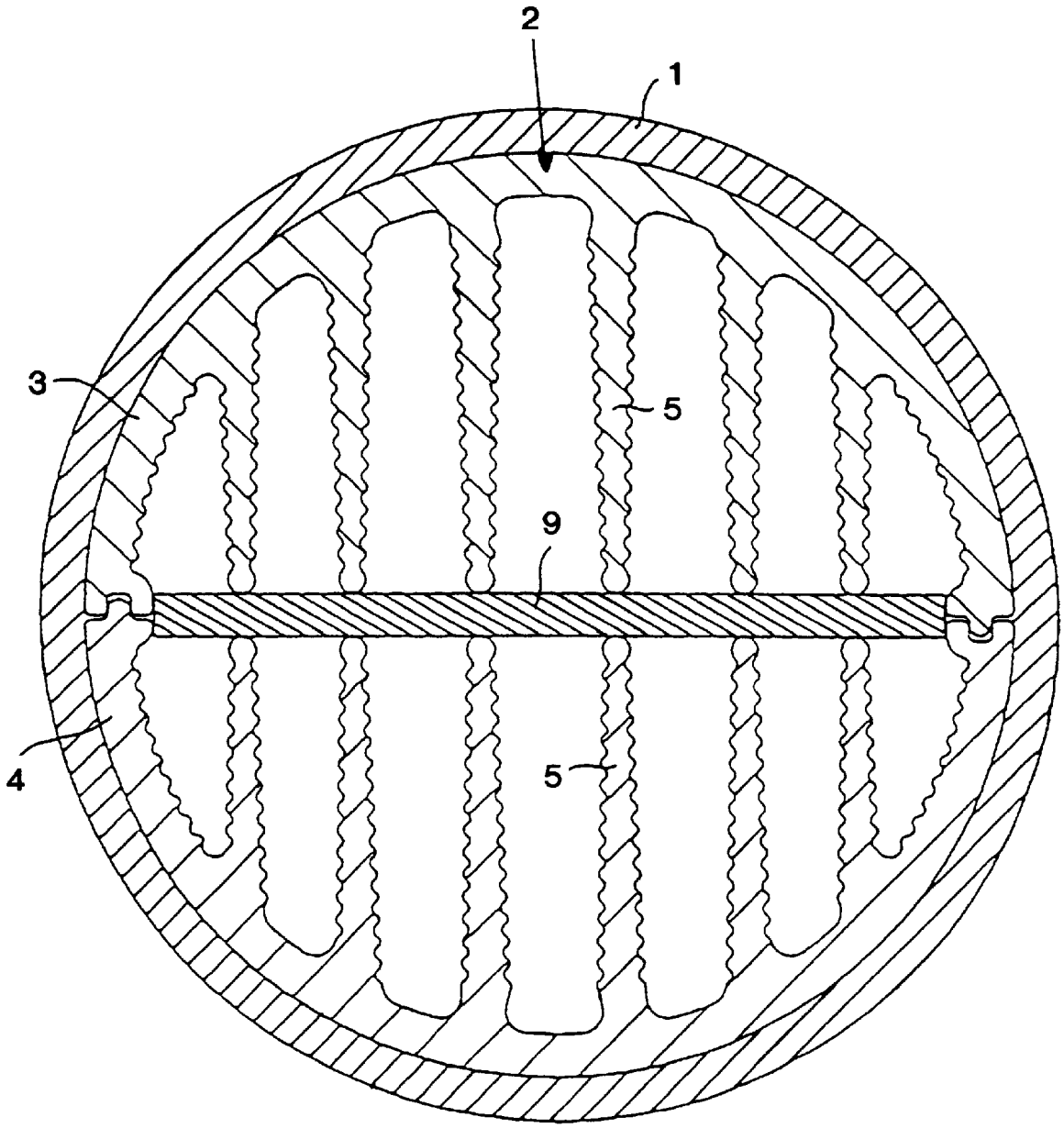
FIG. 2 shows an embodiment of the type of FIG. 1 with a simple additional feature for increasing the internal surface area.

FIG. 2 shows an exemplary embodiment similar to FIG. 1 in which the tips of the ribs 5, which are arranged in the manner of a comb, maintain such a spacing from one another that a plate-shaped flat profile 9 of aluminium can be inserted between the tips. The rib length is so dimensioned that when connecting the half shells 3,4 together to form the tubular profiled insert the comb tips are pressed snugly and gaplessly with their end surfaces corresponding to the rib cross-section against the flat profile 9 in order to produce a reliable heat conductive contact between the flat profile and the ribs. Furthermore, the contacting longitudinal edges of the two half shells can also be so constructed that they trap the longitudinal edges of the flat profile and clamp it between them in a good thermally conductive manner on the finished heat exchanger tube. With the aid of the flat profile inserted between the half shells, the heat-receiving internal surface area of the profiled insert 2 can again be increased in a simple and cheap manner by a considerable amount of the order of 10% or more.

Figure 3:
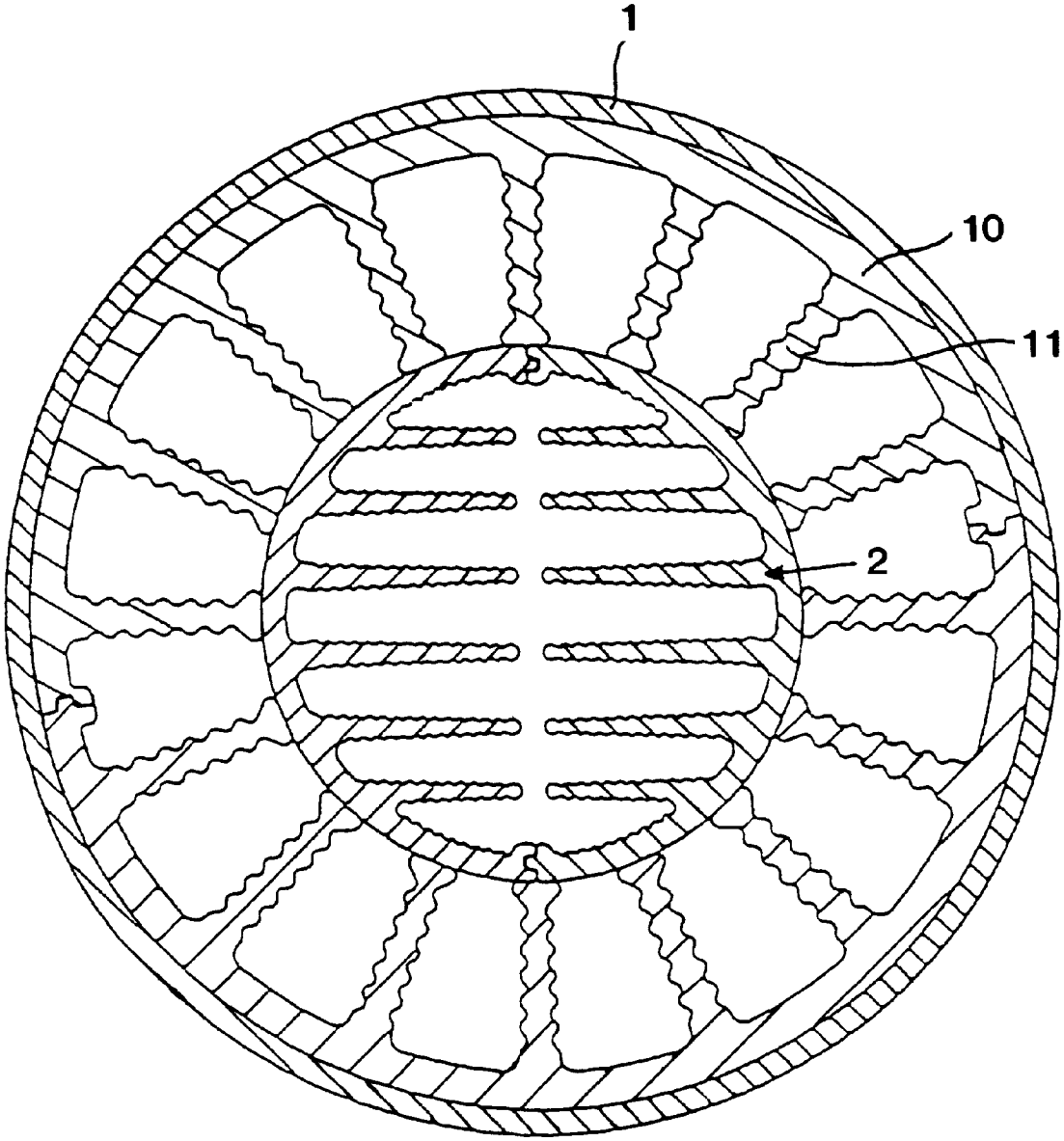
FIG. 3 shows an embodiment with a profiled insert of the type of FIG. 1 engaging the outer tube indirectly via an intermediate profile.

FIG. 3 shows an exemplary embodiment in which the aluminium profiled insert 2 of the type of FIG. 1 does not contact the internal surface of the outer tube 1 directly with its outer surface but has an external diameter which is substantially less than the internal diameter of the outer tube 1. Disposed in the annular space which is thereby defined between the outer tube 1 and the profiled insert 2 is an annular cylindrical intermediate profile 10 of aluminium. This intermediate profile 10 comprises a tubular wall which engages the entire inner surface of the outer tube 1 in a thermally conductive manner with its entire outer peripheral surface, and a plurality of ribs 11, which are radially disposed on the internal surface of the tubular body and which extend to the external surface of the profiled insert 2 and contact the external surface of the profiled insert flatly and in a thermally conductive manner. The intermediate profile 10 is divided in a manner similar to the internal profiled insert 2 in a joint plane, which extends through the longitudinal axis of the outer tube, into two intermediate profile halves, which are open on one side and which can thus also be manufactured from aluminium with a simple drawing die without a flying core by extrusion. The intermediate profile 10 is, in a manner similar to the profiled insert 2 described with reference to FIG. 1, constructed with longitudinal edges of the two intermediate profile halves which contact or engage in one another in a sealed manner. By comparison with the embodiment of FIG. 1, the heat-receiving total internal surface area, which can be contacted by the combustion gases, of the heat exchanger tube can be easily increased by 100% with the embodiment of FIG. 3. The length of the heat exchanger tube can thus be yet further substantially shortened in order to cool the combustion gases in a condensing boiler from an inlet temperature of, for example, 850° C. to an outlet temperature significantly below the dew point threshold of the combustion gases of, for example, 48° C.

I claim:

1. A heat exchanger tube for heating boilers, particularly for gas condensing boilers, comprising:

an elongated cylindrical outer tube having a smooth-walled internal surface and a smooth-walled external surface, the cylindrical outer tube being made of steel;

an elongated tubular profiled insert having an upper half shell, a lower half shell, and a length, the profiled insert being made of aluminum, each half shell having an internal surface that projects to an open plane, an external surface having a diameter, a plurality of ribs extending internally from the internal surface of each half shell towards the open plane of each half shell and extending longitudinally over the length of the profiled insert, and extends vertically from the internal surface of each half shell and perpendicularly towards a joint plane, each rib of the first half shell adapted to align with a rib within the plurality of ribs of the second half shell, a first longitudinal edge having a groove-shaped recess and extending longitudinally over the length of the profiled insert, a second longitudinal edge having a rib-shaped projection and extending longitudinally over the length of the profiled insert, each first longitudinal edge and second longitudinal edge being engaged to one another to form a seal and the tips of each rib defining an open space as a joint plane; and a plate-shaped flat profile arranged within the open space between the upper half shell and lower half shell to be in thermally conductive contact with each rib of each half shell, the plate-shaped flat profile being made of aluminum, where the external surface of the profiled insert is concentric to and in thermally conductive contact with the internal surface of the outer tube.

2. The heat exchanger tube of claim 1, the external surface of the profiled insert having an entire periphery wherein the external surface of the profiled insert directly engages the internal surface of the outer tube longitudinally over the entire periphery of the external surface of the profiled insert.

3. The heat exchanger tube of claim 1 wherein the groove-shaped recess engaged to the rib-shaped projection forms a labyrinth seal.

4. The heat exchanger tube of claim 3 wherein each of the plurality of ribs has an external surface, the internal surface of each half shell including the external surface of the plurality of ribs further comprised of a rib-like surface profiling extending in the longitudinal direction over the length of the profiled insert.

5. The heat exchanger tube of claim 1, the external surface of the profiled insert having a diameter and the internal surface of the outer tube having a diameter, wherein the diameter of the external surface of the profiled insert is substantially less than the diameter of the internal surface of the outer tube, the heat exchanger tube further comprising:

an elongated intermediate profile having an upper intermediate half, a lower intermediate half, and a length, the intermediate profile being made of aluminum and disposed between the internal surface of the outer tube and the external surface of the profiled insert, each intermediate half having an internal surface, an external surface, a plurality of ribs extending radially from the internal surface of each half shell to a location adjacent to the external surface of the profiled insert and extending longitudinally over the length of profiler insert, a first longitudinal edge having a groove-shaped recess and extending longitudinally over the length of profiler insert, a second longitudinal edge having a rib-shaped projection and extending longitudinally over the length of the intermediate profile, each first longitudinal edge and second longitudinal edge being engage to one another to form a seal, where the intermediate profile is in thermally conductive contact with the outer tube and the profiled insert.

6. The heat exchanger tube of claim 5 wherein the groove-shaped recess engaged to the rib-shaped projection of the intermediate profile form a labyrinth seal.

7. The heat exchanger tube of claim 6 wherein each of the plurality of ribs of the intermediate profile has an external surface, the internal surface of each intermediate half including the external surface of the plurality of ribs of the intermediate profile further comprised of a rib-like surface profiling extending in the longitudinal direction over the length of the intermediate profile.

8. The heat exchanger tube of claim 5, the external surface of the intermediate profile having an entire periphery wherein the external surface of the intermediate profile directly engages the internal surface of the outer tube longitudinally over the entire periphery of the external surface of the intermediate profile.

9. A heating boiler, comprising:

at least one heat exchanger tube having an elongated cylindrical outer tube having a smooth-walled internal surface and a smooth-walled external surface, the cylindrical outer tube being made of steel, said at least one heat exchanger tube further having an elongated tubular profiled insert having an upper half shell, a lower half shell, and a length, the profiled insert being made of aluminum, each half shell having an internal surface that projects to an open plane, an external surface having a diameter, a plurality of ribs extending internally from the internal surface of each half shell towards the open plane of each half shell and extending longitudinally over the length of the elongated tubular profiled insert, wherein the plurality of ribs of each half shell extends vertically from the internal surface of each half shell and perpendicularly towards the joint plane, each rib of the first half shell adapted to align with a rib within the plurality of ribs of the second half shell, a first longitudinal edge having a groove-shaped recess and extending longitudinally over the length of the elongated tubular profiled insert, a second longitudinal edge having a rib-shaped projection and extending longitudinally over the length of the elongated tubular profiled insert, each first longitudinal edge and second longitudinal edge being engaged to one another to form a seal and the tips of each rib defining an open space as a joint plane, where the external surface of the profiled insert is concentric to and in thermally conductive contact with the internal surface of the outer tube, said heat exchanger tube welded to the heating boiler; and a plate-shaped flat profile arranged within the open space between the upper half shell and lower half shell to be in thermally conductive contact with each rib of each half shell, the plate-shaped flat profile being made of aluminum.

* * * * *

UNITED STATES PATENT AND TRADEMARK OFFICE

CERTIFICATE OF CORRECTION

PATENT NO.: 6,070,657

DATED: June 6, 2000

INVENTOR(S): Wolfgang Kunkel

It is certified that error appears in the above-identified patent and that said Letters Patent is hereby corrected as shown below:

At Inventor, Item [75], delete "Triesten" and insert -- Triesen --.

At Foreign Application Priority Data, Item [30], delete "94 05 062 U" and insert -- 94 05 062.7 U --.

At Foreign Patent Documents, Item [56], delete "of 1902" and insert -- 4/1992 --.

In Claims, at Claim 1, the first subparagraph, delete "steel;" and insert -- steel; and --.

In Claims, at Claim 1, the last subparagraph, delete "where" and insert -- wherein --.

In Claims, Claim 7, delete "Claim 7" and insert -- Claim 8 --.

In Claims, Claim 8, delete "Claim 8" and insert -- Claim 7 --.

In Claims, reverse the order of currently numbered Claims 7 and 8 so that they appear in their corrected numerical order.

UNITED STATES PATENT AND TRADEMARK OFFICE

CERTIFICATE OF CORRECTION

PATENT NO.: 6,070,657

DATED: June 6, 2000

INVENTOR(S): Wolfgang Kunkel

It is certified that error appears in the above-identified patent and that said Letters Patent is hereby corrected as shown below:

In the Claims, at Claim 5, in the next to the last subparagraph, delete "engage" and insert -- engaged --.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*